United States Patent [19]

Garchinsky

[11] 4,149,230

[45] Apr. 10, 1979

[54] VISUAL LATCHING CONDITION INDICATING SYSTEM FOR TALL POLE CARRIER ASSEMBLY

[75] Inventor: John S. Garchinsky, Aldan, Pa.

[73] Assignee: Gar Design Research, Inc., Media, Pa.

[21] Appl. No.: 835,509

[22] Filed: Sep. 22, 1977

[51] Int. Cl.[2] ..... F21V 21/14; B42F 13/00

[52] U.S. Cl. ..... 362/403; 362/396; 248/320

[58] Field of Search ..... 362/391, 431, 403, 396, 362/401, 402, 407, 418, 430; 116/2, 114 AJ; 248/320, 330, 322, 339

[56] References Cited

U.S. PATENT DOCUMENTS

| | | | |
|---|---|---|---|
| 3,911,267 | 10/1975 | Kiehn | 116/134 |
| 4,001,573 | 1/1977 | Derasp | 240/64 |

*Primary Examiner*—William M. Shoop
*Assistant Examiner*—Peter S. Wong
*Attorney, Agent, or Firm*—Nelson E. Kimmelman

[57] ABSTRACT

A plurality of cables having respective first ends attached to selected portions of a carrier for lights or the like pass over pulleys in the mast head atop a high pole, their other ends being coupled internally of the pole to a winch which winds the cables to raise and lower the carrier for maintenance purposes from its normal highest position. At the latter position latching members on the carrier engage corresponding latching members on the mast head and the latches normally provide the principal suspending support for the carrier. As a safety measure, the ends of the cables coupled to the carrier are provided with signals visible from the ground indicating when the various latching means have been properly engaged.

12 Claims, 12 Drawing Figures

FIG. 1
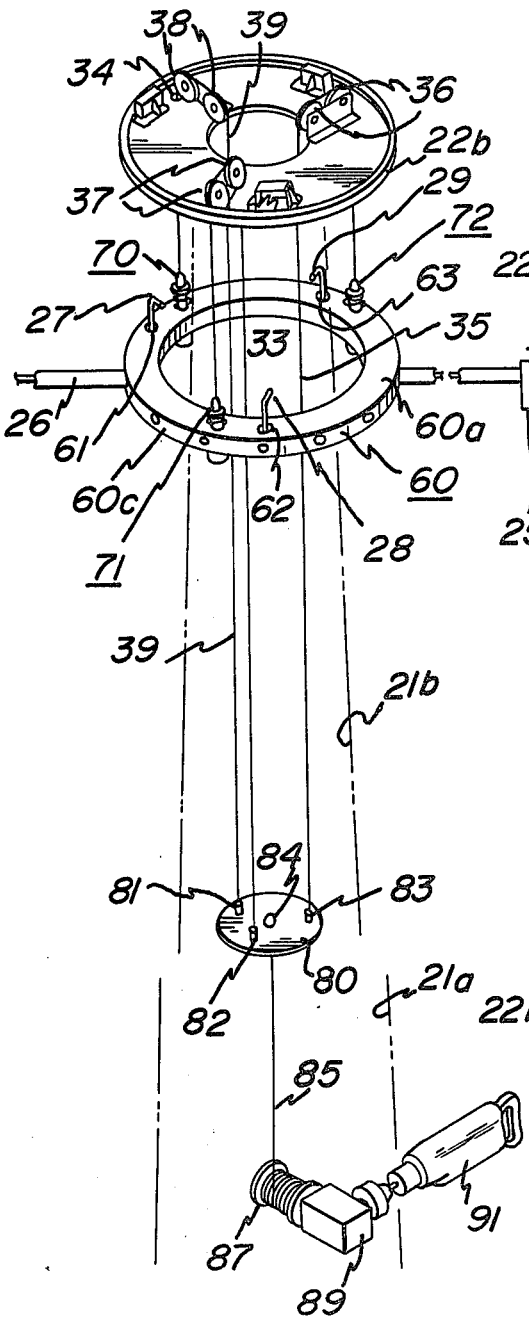
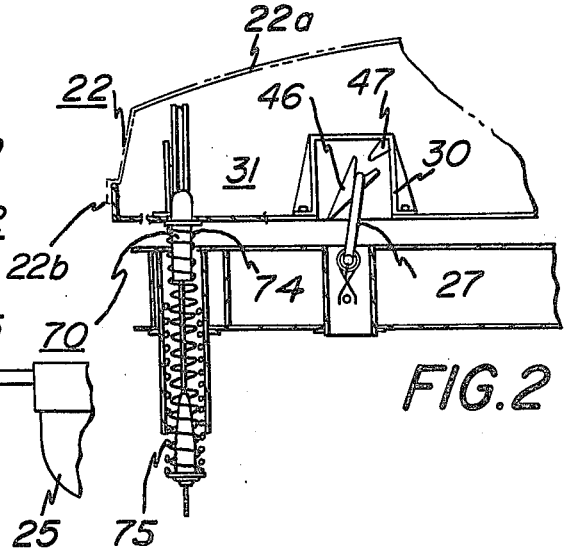
FIG. 2
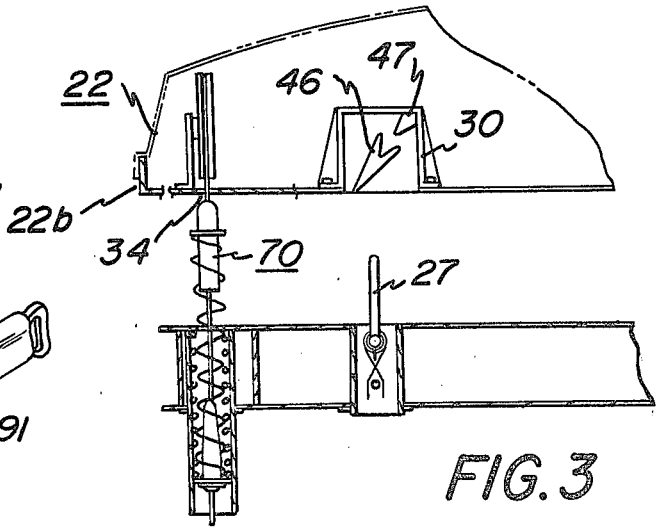
FIG. 3

VISUAL LATCHING CONDITION INDICATING SYSTEM FOR TALL POLE CARRIER ASSEMBLY

BACKGROUND OF THE INVENTION — FIELD OF THE INVENTION

This invention relates to systems for raising carriers for luminaires or the like to the top of a high pole and, in particular, to a system for enabling a maintenance man on the ground to visually ascertain that the carrier is being suspended from the top of the pole by its associated latching mechanisms.

BACKGROUND OF THE INVENTION — PRIOR ART

In recent years, poles for holding street lights outdoors have been made taller and taller. Since they are further from the ground, they must employ more powerful light and appropriate lenses for dispersing light so that the illuminated area is much greater than poles of lesser height. One reason for using fewer, taller poles rather than a larger number of shorter poles adjacent the highway, especially near highway intersections, is that fewer poles reduce the number of accident hazards to motorists.

The newer poles have attained heights of about 150 feet. With such height, their bulbs or lamps are out of the range of conventional "cherry pickers" and, therefore, servicing of them (including bulb replacement) is more difficult than with shorter poles. Nor is it practical to have built-in or removable ladders to enable maintenance personnel to extend the pole to service the luminaires.

To meet the more difficult problems of bulb replacement and general maintenance concomitant with taller poles, a number of schemes have been evolved.

First, each of the luminaires was suspended by a steel cable passing upward through the hollow pole and over pulleys at the top. This enabled each light individually to be lowered to the ground when desired simply by unwinding a sufficient length of the cable. One problem with this arrangement was that the luminaires simply hung from individual steel cables and tended to be blown around or to sway violently in the wind thereby causing wear on the cable and damage to the luminaire. Also, over an extended period of time, the steel cable tended to stretch causing the luminaire attached thereto to be lower than its desired height.

A later approach was to mount several of the luminaires on a movable carrier which was suspended from the top of the pole by means of several steel cables passing upward inside the pole and over pulleys. Thus, when the carrier was lowered, the luminaires were accessible for maintenance or repair and then the carrier was raised by winding up the same cables. Again, over an extended period of time, if the cables were the sole means for suspending the carrier, they might tend to stretch. To relieve some of the constant strain that otherwise might be imposed on the cables if used as the sole support, the carriers were equipped with a number of latching supporting mechanisms which engaged corresponding mechanisms on the mast head at the top of the pole.

However, even with the use of latched carriers, the assemblies of higher poles with luminaire raising and lowering systems continued to present safety problems. First of all, the carrier itself could easily weight 1500–1800 pounds so that, in the event of a mishap during raising or lowering of the carrier, the falling carrier could endanger the life of the maintenance worker or others below.

Second, even where a number of steel cables have been used to raise and lower the carrier, those cables often became stretched and different cables might have different stretching characteristics. Any unevenness in the raising of the carrier itself further contributed to additional or uneven stretching.

Third, such tall pole assemblies often were extremely hazardous to the operating or maintenance personnel, especially in the lowering operation, in the event one of the cables became stuck or slack.

One prior art assembly intended to improve the safety of these tall pole systems by aiding in preventing or detecting abnormal unevenness in the raising or lowering of the carrier is disclosed in my co-pending application Ser. No. 723,099 entitled "Luminaire Raising and Lowering System", filed Sept. 14, 1976. That system employed certain self-adjusting linkage members between the ends of the cables and a primary cable which was actually wound up by the winch. In addition, it disclosed a system for detecting undue slack in the winch cabel thereby preventing further vertical movement of the winch cable. While that system was quite effective, I have devised an alternative system, employing a different principle, to signal the maintenance man as to normal and abnormal conditions in the raising and lowering of the carrier.

It is therefore among the objects of the present invention to provide a system for use with tall luminaire poles, or the like, with associated luminaire carriers, which are safer to operate and maintain. This invention includes improved sub-assemblies on the carrier which engage the mast head and provide shock-absorbing action as well as a visual indication to the maintenance man of normal and abnormal raising and lowering conditions. Still other objects will appear upon perusal of the specification and drawings herein.

BRIEF SUMMARY OF THE INVENTION

In a system for raising and lowering a carrier to and from a predetermined high position toward the top of a pole, means are provided associated with a carrier to provide signals visible from the ground indicating when the various parts of the carrier are being suspended from the mast head by their respective latching mechanisms.

BRIEF DESCRIPTION OF THE DRAWINGS

FIG. 1 is a fragmentary perspective view showing the main constituents of a typical environment in which the present invention is used;

FIG. 2 is an enlarged fragmentary and sectional view of one part of the system shown in FIG. 1 as viewed in the direction shown by the line "A" in FIG. 1 showing the proper engagement of the novel part of the carrier with the mast head in the latched condition;

FIG. 3 is an enlarged fragmentary and sectional view of the same part of the system as shown in FIG. 2 when the novel part of the carrier is disengaged from the mast head;

DESCRIPTION OF THE PREFERRED EMBODIMENTS

Figures 4, 4A:
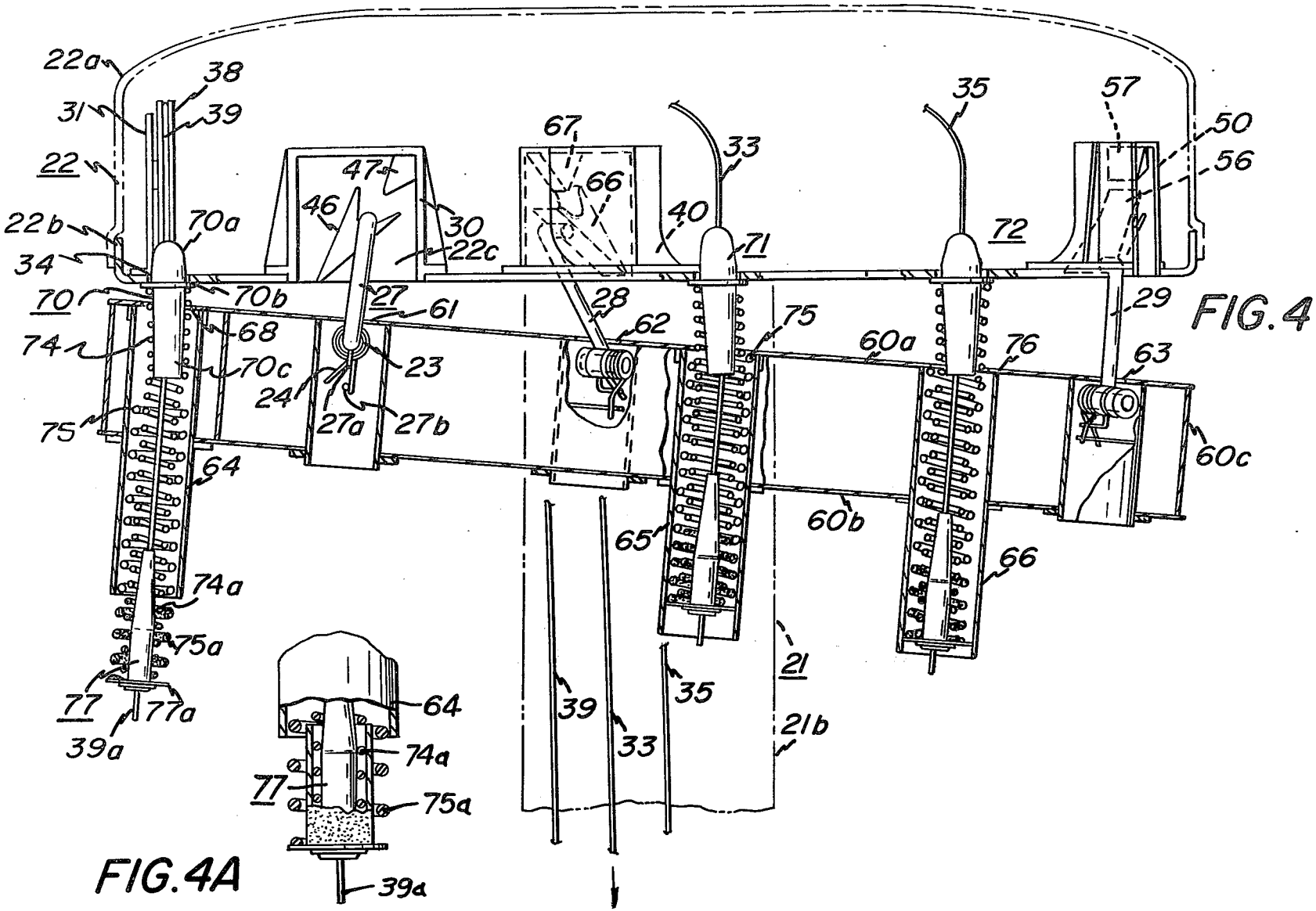
FIG. 4 is an enlarged fragmentary and sectional view of the carrier and mast head, somewhat distorted for expository purposes only, showing a condition of uneven engagement of the carrier with the mast head.
FIG. 4A is a partially sectional view of an alternative embodiment of the invention.
Figure 5:
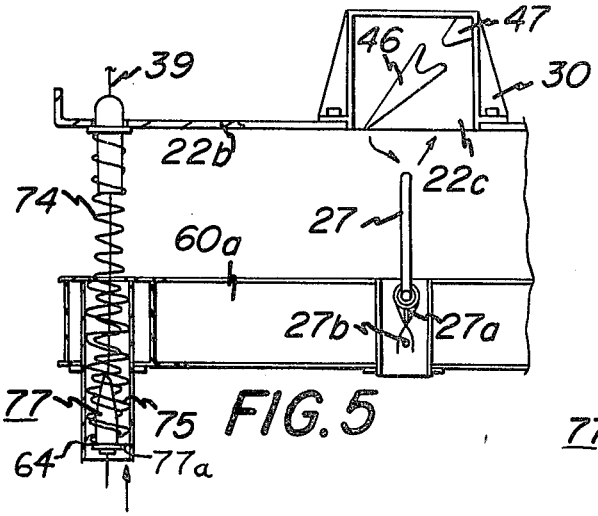
FIGS. 5–8 are fragmentary, partly sectional views, essentially schematic, of the process of engagement of the latching mechanism during raising of the carrier to the mast head.

FIG. 1 shows a luminaire raising and lowering system of the type illustrated in my co-pending application mentioned above. It includes a mast head 22 (FIG. 2) having a lower portion 22*b* situated at the top 21*b* of a pole 21 (FIG. 4). The mast head also has a top portion 22*a* to protect its contents from the elements. Three pairs of pulleys 36, 37 and 38, spaced apart 120°, are mounted on brackets such as the bracket 31. The pulley pairs 36, 37 and 38 have carrier cables 35, 33 and 39 passed over them whose ends are connected respectively to parts 72, 71 and 70 of bumper and carrier positioning subassemblies. The other ends of the cables 35, 33 and 39 pass through the disc or plate 180 which has three holes (not shown) which may be counter sunk and are spaced apart 120°.

In the embodiment illustrated, the cables are respectively terminated by metallic terminating elements 81, 82 and 83. These are described in detail and illustrated in my aforementioned copending application (FIG. 13). Each of the terminators 81, 82 and 83 comprises a generally cylindrical sleeve into which the end of the cable is inserted. Integrally formed at the end of the sleeve is a bulbous terminal portion larger than the hole through which the cable and sleeve pass. This allows the plate or disc 80 to assume horizontal or off-horizontal positions depending upon the pull exerted by each of the cables on the disc. In the center of the disc 80 there is another hole through which winch cable 85 passes which is itself similarly terminated by a terminator 84 having substantially the same construction as terminators 81, 82 and 83. Terminator 84 has, as seen, a terminal bulbous or spherical portion larger than the hole through which its attached sleeve passes.

The winch cable 85 extends down to and is wound around a winch spool or drum 87 connected on a shaft to a gear box 89 that may be releasably coupled, when it is desired to raise or lower the carrier, to a portable power drill 91 passed through an opening in the base 21*a* of the pole 21 by a maintenance man.

Figure 9:
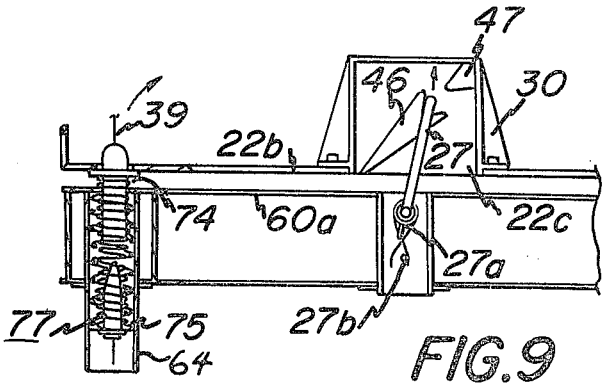
FIGS. 9–11 are fragmentary, sectional views, essentially schematic, of the process of disengagement of the latching mechanisms illustrated in FIG. 4 during lowering of the carrier from the mast head.
Figure 11:
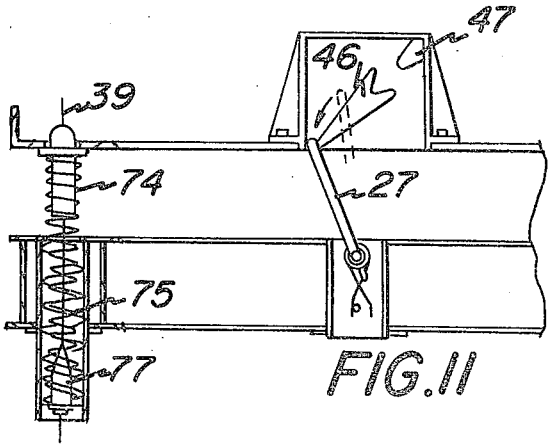

While FIG. 1 shows a system with three carrier-raising cables, it is to be understood that it is equally applicable to systems using other numbers of cables such as four with corresponding numbers of pairs of pulleys. Furthermore, the linkage connecting the winch cable 85 to the individual cables 33, 35 and 39 may take other forms such as shown in FIGS. 9, 11 and 12 of my aforementioned copending application, or, in fact, may be dispensed with entirely since the invention resides in other areas of the system such as the one shown in FIG. 1.

The carrier indicated generally at the numeral 60 comprises an annular structure having an annular top planar section 60*a* an annular planar bottom section 60*b* (FIG. 4) and a curved side wall 60*c*. Extending out of the side wall are one or more tenons 26 to which a corresponding number of luminaires 25 are attached. Wires for the luminaires pass through the tenons into the carrier 60, and eventually down through the pole 21.

Associated with the carrier 60 are a plurality of latch arms 27, 28 and 29 having the generally L-shaped configurations as shown. The latch arms normally assume a substantially vertical rest or center position caused by opposing forces exerted by opposing coil springs 23 and 24 (FIG. 4) against member 27*a* which is fixed to the bottom of the arm 27 and rotates in unison therewith. Whenever the arm 27 goes to an off-center position, the free ends of the springs bear against a center stop member 27*b* (FIG. 4) which, as the deflection of the arm increases, causes the spring to exert more restorative bias on the arm. The arms 27, 28 and 29 protrude through respective holes 61, 62 and 63 formed in the top portion 60*a*.

Whenever the carrier 60 is raised to the top of the pole 21, the arms 27, 28 and 29 engage fixed latching elements positioned just above them within the enclosures 30, 40 and 50 attached to the lower portion 22*b* of the mast head. Each enclosure 30, 40 and 50 is positioned above an opening 22*c* (FIG. 4) formed in the lower portion 22*b* of the mast head. The construction of the latch arms and their cooperation with the stationary latch elements is generally shown and explained in my aforementioned copending application, but will again be explained somewhat in connection with the operation of the present invention.

The description of the drawings so far involves structural elements forming a typical environment for the present invention. In my aforementioned copending application a number of elements associated with the carrier were described which served to absorb the shock of the raising of the carrier into contact with the mast head as well as to fix or stabilize the azimuthal position of the carrier relative to the mast head. The system described there also described an electromechanical system for detecting abnormality in the tension of the cable or cables used to raise the carrier to the mast head.

According to the present invention, subassemblies are provided not only stabilize the carrier against rotation in the horizontal plane around the pole 21 and to absorb the shock of impact as the carrier is raised to the mast head, but also to provide a visual signal to the maintenance operator that tends to indicate normal and abnormal conditions in the elevating system as the carrier is about to be latched to, or unlatched from, the mast head.

FIG. 4 is especially useful in understanding the structure of the subassemblies 70, 71 and 72. FIG. 4 is not intended to accurately depict the structure of the mast head and carrier since such depiction would not be as revealing or as instructional. Rather, FIG. 4 is intended to show simultaneous conditions in the three latching subassemblies when the carrier is raised to the mast head in an uneven fashion. To this end certain liberties in the presentation have been taken. Since the construction of all three latching subassemblies is essentially identical, only the subassembly associated with cable 39 will be explained.

The latter subassembly has a member 70 with a rounded-off top portion 70*a* to facilitate its entry into the hole 34 formed in portion 22*b*, a rim or flange portion 70*b* and a lower shaft portion 70*c*. The top end turn of an inner spring 74 is welded or otherwise fixed to the member 70 just below the rim 70*b*. The spring 74 passes all the way through a tubular compartment 64 (identical to corresponding compartments 65 and 66 associated with members 71 and 72) which extends vertically through the carrier 60 and for some distance below it. The lower end 74*a* of spring 74 abuts the generally disc-like base 77*a* of the cable terminating member 77 and is painted a brilliant orange color (shown as stippled). The pulley cable 39 passes downward through an axial passageway in the member 70, through the inner spring 74 and into the terminating member 77 which also has an axial passageway in it. The terminating member 77 may be, for example, an automatic compression fitting such as ones sold by Reliable Company under the designation "STRAND-VISE". This compression fitting 77 includes within its outer housing a plurality of tapered jaws, a spring and a spring cup. When a cable is passed through it, the jaws are forced down upon the cable by the spring assembly thus firmly setting the jaws. The amount of the cable end 39*a* protruding from the fitting may be adjusted, if desired, to account for stretch of cable 39 or for other non-uniformities. Surrounding the inner spring 74 and extending partially into chamber 64 is a larger concentric spring 75 which is considerably heavier and stiffer than inner spring 74. Its upper end is free and ordinarily has its lower end 75*a* rest upon the base 77*a*. Like end 74*a* it is painted a brilliant orange color.

As shown in FIG. 4, when the cable 39 is pulled down in the carrier raising operation, it pulls the terminator 77 whose base 77*a*, in turn, forces the inner spring 74 well out of hole 68. It also pushes up the outer spring 75 until its top bears against the lower surface of the portion 60*a* of the carrier. Since spring 75 is stiff and heavy, it urges that part of the carrier upwardly. Similarly, the corresponding outer springs of the other subassemblies also push their associated regions of the carrier up as soon as the springs contact the member 60*a*. As the winch cable 85 continues to wind up it pulls, via the linkage member 80, the carrier cables 33, 35 and 39 so that the carrier will continue to rise. Due to nonuniformities in the system such as differences in the extent to which the carrier cables have been stretched when under load, it may happen that the portion 70*a* is the first to fully pass into hole 34 so that its rim 70*b* presses against the lower surface of portion 22*b*. Continued pull on the cable 39 will cause the base 77*a* to enter the tubular compartment 64 which will compress outer spring 75 even more thereby continuing the upward movement of that part of the carrier 60.

Figure 6:
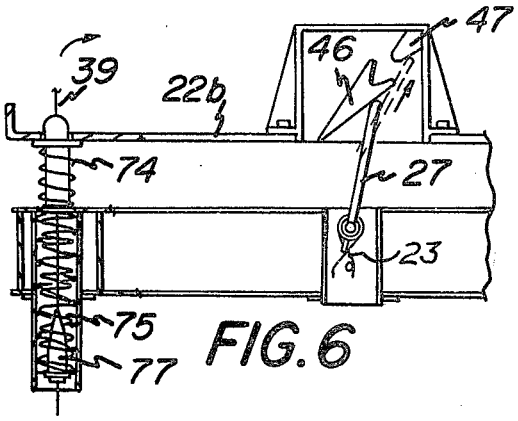

In the meantime, as the carrier is being raised, so are the latch arms 27, 28 and 29. After initial engagement of the hole 34 by the member 70, the latch arm 27 approaches the lower edge of the member 46. As the tension increases on the cable 39, that part of carrier 60 is moved even further upward so that the terminating element 77 exerts more compressive force on the outer spring 75. As shown in FIG. 6, the upper end of the latch arm 27 then contacts and starts to ride up the lower edge of the member 46 thereby causing the latch arm to incline toward the right with the end of the spring 23 exerting pressure on the right side of the central stop member 27*b*. Continued tension on the cable 39 forces the arm 27 up past the right lower corner of the member 46 and up past the corner of the member 47 as shown in broken lines in FIG. 6. The upper movement of the arm 27 and of the carrier in that region ends when the arm 27 rides up to its maximum point on the lower edge of element 47.

Figure 7:
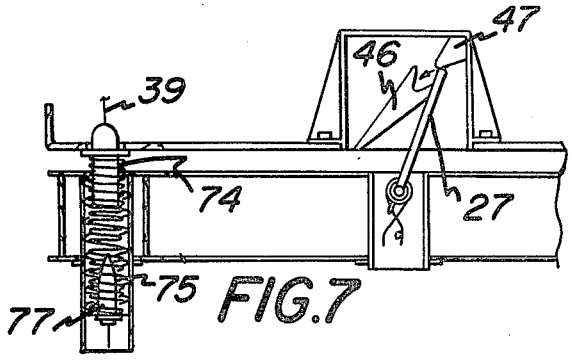
Figure 8:
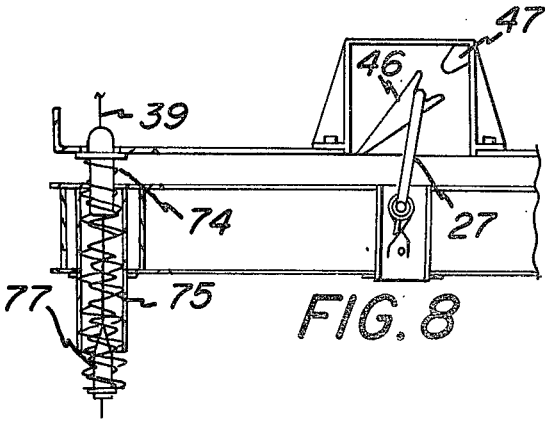

At that point, the operator begins to relax the cable 39 a slight bit as shown in FIG. 7 whereupon the spring urges the arm 27 to pivot counterclockwise past the corner of element 47, which is lower than the left corner of the element 46, until it engages the left wall of the valley between the two corners. When the cable is paid out a slight bit more, the downward movement of the carrier will, as shown in FIG. 8, cam the upper end of the arm 27 down the left wall of the valley until it nestles in the base of the valley. When the latching is complete and the cable 39 is relaxed, the springs 74 and 75, having moved down past the lower edge of the chamber 64 with the terminating element 77, expose their respective lower orange-colored portions 74*a* and 75*a* to the maintenance man below. When he sees this, he knows that, at least, that portion of the carrier has been secured by the proper functioning of the latching subassembly.

However if, because of stretching or other nonuniformities in the system, the other parts of the carrier 60 have not yet been latched into supporting engagement with the mast head, by reference to FIG. 4 it is seen that neither of the orange end portions 74*a* and 75*a* will protrude beneath the respective chambers 65 and 66. This will signal to the operator below that the carrier is supported mechanically at one part only by the action of the latch arm 27 with its associated latching elements 46 and 47, whereas the other parts of the carrier are supported only by the respective cables 33 and 35.

Down Cycle Operation

Figure 10:
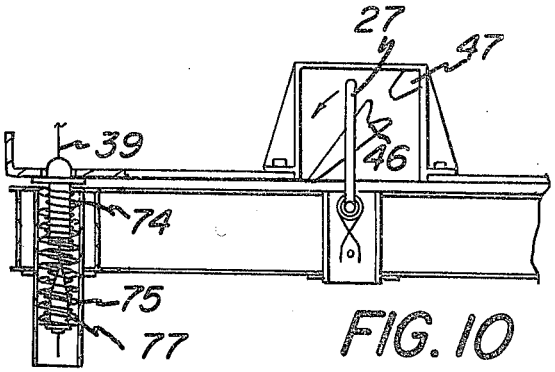

The "down" cycle of the carrier and the operation of the latching mechanisms is shown in FIGS. 9–11. At first, the maintenance man winds up the winch somewhat until he sees that the orange-colored portions 74*a* and 75*a* are no longer visible. When the latch arm is raised above the top corner of the latching element it pivots slightly counterclockwise to the 12:00 position. Then the maintenance man pays out the cable whereupon the carrier begins its descent with the orange-colored portions still not being visible. As the carrier descends, the upper end of the latch arm 27 rides downward and is cammed somewhat counterclockwise by the upper edge of the element 46 thereby causing the other spring attached to arm 27 to exert pressure on the left side of the centering stop 27*b*. The position of the latch arm half-way down is shown in broken lines in FIG. 11. Continued relaxation of the cable 39 enables the latch arm to go down past the lower tip of the element 46 whereupon it is urged to its 12 o'clock position by the action of the biasing springs cooperating with the top or centering element 27*b*. This position of the latch arm is maintained all the way down so that the terminating element 77 and the lower ends 74*a* and 75*a* of the springs never emerge from the lower bottom opening of the chamber 64 so as to be visible to the maintenance man.

FIG. 4A shows an alternative embodiment of the invention in the region of the ends of the supporting cables. In lieu of painting the lower ends of one or both springs 73 and 74 orange, it is possible to leave them unpainted but, instead, to insert a brightly orange-colored tube of plastic, for example, down near the terminator 77 between the springs 74 and 75. It can be attached, for example, to the upper surface 77*a* of the terminator or may merely be left free to bear against the surface 77*a* by its own weight. If the tube is impregnated with the orange color, repeated raising and lowering of the carrier will not affect it. This prevents eventual erosion of the costs of paint on portions 74a and 75a by friction that could occur in the use of the invention according to the first embodiment.

I claim:

1. A system for raising and lowering a carrier to and from a predetermined high position toward the top of a pole, comprising (a) a mast head situated at said predetermined high position and having a plurality of first latching means, (b) a carrier having a plurality of second latching means which when it is at said high position, engage associated ones of said first latching means for principally suspending said carrier from said mast head, (c) a plurality of substantially vertical cables mounted to move in said mast head for lowering and raising said carrier and having respective first ends coupled to corresponding selected portions of said carrier, (d) means coupled to the second ends of said plurality of cables for imparting vertical movement to them for raising and lowering said carrier, and (e) means carried by said carrier and associated with said first ends of said plurality of cables for providing signals below the lower surface of said carrier which are visible from the ground for indicating said selected portions of said carrier are being principally supported by engagement of their associated ones of said second latching means with the corresponding ones of said first latching means, said means for providing visible signals including a plurality of resilient means respectively coupled to said first ends, each of said resilient means having at least portions which have a high visibility coloration and protrude from said carrier when the associated selected portion of said carrier is principally suspended from said mast head by the latching action of the associated ones of said first and second latching means.

2. The system according to claim 1 wherein each one of said plurality of resilient means comprises a plurality of springs whose lower portions are colored a high visibility orange.

3. The system according to claim 1 wherein each of said means for providing said visible signals comprises a sleeve having a high visibility coloration.

4. The system according to claim 2 wherein each of said plurality of springs comprises an inner spring through which said first cable end passes and an outer spring surrounding and coaxial with at least the lower part of said inner spring and wherein said outer spring cooperates with said first cable end to support said associated selected portion of said carrier when it is unlatched from said mast head.

5. The system according to claim 4 wherein said inner spring normally protrudes upwardly from said carrier and urges an associated positioning member into contact with a predetermined part of said mast head.

6. The system according to claim 5 wherein said predetermined parts of said mast head comprise a plurality of openings in its bottom wall adapted to be engaged by associated ones of said positioning members, said members having upper tapered portions to facilitate entry into their associated openings, said members also having longitudinal passages through which respective ones of said cables pass.

7. The system according to claim 2 wherein one spring of each of said plurality of springs normally protrudes upwardly from said carrier and said lower portion of a second spring of said plurality protrudes downwardly beneath said carrier, normally only when the associated selected portion of said carrier has been latched to said mast head, both of said springs being disposed in an elongated vertical compartment in said carrier.

8. In a system in which a carrier for luminaires or the like is raised by cables or the like to the mast head of a tall pole for suspension therefrom primarily by engagement of latching means in said carrier with latching means on said mast head, the improvement comprising:

means for providing below the lower surface of said carrier an indication visible from the ground when said carrier is being suspended from said mast head primarily by engagement of said latching means, said means for providing a visible indication being associated with means associated with said carrier for positioning said carrier relative to said mast.

9. In a system in which a carrier for luminairies or the like is raised by cables or the like to the mast head of a tall pole and in which said mast head and said carrier each include corresponding latching means which primarily suspend said carrier from said mast head when they are engaged, the improvement comprising:

means borne by said carrier and associated with said latching means in said carrier for providing an indication below the lower surface of said carrier which is visible from the ground when said carrier latching means have engaged the corresponding latching means in said mast head, said means providing a visible indication being associated with means for positioning said carrier relative to said mast head.

10. In a system according to claim 9 wherein said mast head and said carrier each have a plurality of said latching means and wherein said means for providing a visible indication comprises respective bright-colored means associated with each carrier latching means.

11. In a system according to claim 9 wherein said means for providing said visible indication comprises resilient means, said resilient means also being constructed and arranged to absorb the shock of impact of said carrier with said mast head.

12. In a system according to claim 11 wherein the lower ends of said resilient means protrude downward from said carrier only when their associated carrier latching means engage corresponding ones of said mast head latching means, said protruding ends having a high visibility coloration.

* * * * *